US005819331A

United States Patent [19]

Miuccio

[11] Patent Number: 5,819,331

[45] Date of Patent: Oct. 13, 1998

[54] URINAL ATTACHMENT FOR A TOILET

[76] Inventor: Edward Miuccio, 88 Main St., Lincoln Park, N.J. 07035

[21] Appl. No.: 842,921

[22] Filed: Apr. 14, 1997

[51] Int. Cl.[6] ..... E03D 13/00

[52] U.S. Cl. ..... 4/341; 4/301; 4/307; 4/242.1

[58] Field of Search ..... 4/301, 340, 341, 4/342, 307, 312, 242.1, 415, 300.3, 234, 230

[56] References Cited

U.S. PATENT DOCUMENTS

| | | |
|---|---|---|
| 2,801,424 | 8/1957 | Mercer . |
| 2,839,764 | 6/1958 | Gardner . |
| 3,412,408 | 11/1968 | Michal, Jr. . |
| 3,500,480 | 3/1970 | Michal, Jr. . |
| 4,282,611 | 8/1981 | O'Day . |
| 4,309,782 | 1/1982 | Paulin . |
| 4,458,368 | 7/1984 | Webb . |
| 4,612,676 | 9/1986 | Whitman . |
| 4,716,602 | 1/1988 | Brickhouse . |
| 4,720,880 | 1/1988 | Barreau . |
| 5,117,512 | 6/1992 | Bressler . |
| 5,216,760 | 6/1993 | Brown et al. . |
| 5,373,589 | 12/1994 | Rego et al. . |

*Primary Examiner*—Charles R. Eloshway
*Attorney, Agent, or Firm*—Weingram & Associates, P.C.

[57] ABSTRACT

A urinal attachment for a toilet is provided which consists of a valve assembly mounted to an interior of a tank for the toilet to direct a water supply to a flexible pouch mounted at an underside of the lid of the toilet. A supply hose is connected from the valve assembly to the flexible pouch to rinse the pouch of waste therein and discharge the waste water through an opposite end of the pouch into a drain for the toilet.

11 Claims, 2 Drawing Sheets

URINAL ATTACHMENT FOR A TOILET

BACKGROUND OF THE INVENTION

1. Field of the Invention

The present invention relates to urinal attachments for toilets to receive urine and in particular, to those attachments which deploy from a lid of the toilet and require less water to rinse away liquid waste.

2. Description of the Related Art

Devices are known to be attached to toilets to collect human waste and shield the user from unintentional splashing of the waste. Such devices are disclosed in the following patents.

| U.S. Pat. No. | INVENTOR(S) |
|---|---|
| 2,801,424 | Mercer |
| 2,839,764 | Gardner |
| 3,412,408 | Michal, Jr. |
| 3,500,480 | Michal, Jr. |
| 4,282,611 | O'Day |
| 4,309,782 | Paulin |
| 4,458,368 | Webb |
| 4,612,676 | Whitman |
| 4,716,602 | Brickhouse |
| 4,720,880 | Barreau |
| 5,117,512 | Bressler |
| 5,216,760 | Brown et al. |
| 5,373,589 | Rego et al. |

Urinal Attachments/Devices

U.S. Pat. Nos. 3,412,408 and 3,500,480 to Michal, Jr. each disclose a urinal attachment for a toilet bowl consisting of a urinal bowl hingedly attached to an assembly mounted to a tank of the toilet bowl, and a disposal drain duct extending from a lower end of the urine bowl into the toilet bowl.

U.S. Pat. No. 4,282,611 to O'Day discloses a urinal consisting of a funnel mounted to a bracket assembly which is pivotally connected to the toilet bowl, and a conduit extending from a rinse valve into the funnel to rinse away urine released into the funnel.

U.S. Pat. No. 4,612,676 to Whitman discloses a urinal attachment for a toilet consisting of a body portion having a receptacle into which urine is released, and spaced apart leg means between which the toilet bowl rim is received.

Sampling Devices

U.S. Pat. Nos. 2,801,424 to Mercer and 4,309,782 to Paulin each disclose a device to collect urine and fecal specimens, respectively, which devices consist of a cup or bag supported at the rim of the toilet bowl for the purpose intended.

Shields and Protective Covers

U.S. Pat. No. 5,373,589 to Rego et al. discloses a commode bowl splash guard consisting of a pair of accordion pleated webs in facing coextensive relationship mounted to opposed sides of the toilet rim and bottom of all toilet seats. A connecting web extends between the webs to form a substantially water tight enclosure.

The remaining patents to Gardner, Webb, Brickhouse, Barreau, Bressler, and Brown et al. disclose various devices which function as covers, shields, deflectors, linings and guards for toilet bowls.

OBJECTS AND SUMMARY OF THE INVENTION

The construction and arrangement of the present invention obviates the need for a large amount of water necessary to rinse the bowl of urine. Building and construction codes mandate that toilets have a reduced and more efficient flushing capacity so that the amount of water used to rinse away waste in the bowl is substantially reduced. This requirement arises from not only environmental concerns and the necessary costs to purify water for reuse or introduction back into the environment, but also that water is considered a precious resource which some municipalities tax for access to the water as well as use of the water. Reduction and conservation of water is therefore an important financial consideration as well.

A preferred embodiment of a urinal attachment for a toilet according to the present invention consists of a deployable pouch mounted to a lid of the toilet and into which water from a tank of the toilet is introduced to flush urine in the pouch into a drain of the toilet bowl, thereby reducing the amount of water necessary in order to completely and hygienically dispose of the urine.

It is an object of the present invention to provide a urinal attachment for a toilet which is mounted to existing hardware of the toilet to function for its intended purpose.

It is another object of the present invention to provide a pouch-like receptacle into which urine can be excreted and removed completely by requiring substantially less water that is normally used with conventional toilets and the flushing thereof.

It is another object of the present invention to provide a urinal attachment which uses the existing plumbing, including the drain, of the toilet to which the invention is mounted.

It is another object of the present invention to provide a urinal attachment which is secreted beneath the lid of the toilet and selectively deployed for use when the lid is raised.

It is another object of the present invention to provide a modified lid portion for the toilet in which the urinal attachment can be concealed.

It is another object of the present invention to provide a urinal attachment for a toilet mounted in an aesthetic manner so as to be unobtrusive when the lid of the toilet is in the closed or open position with respect to the toilet bowl.

It is another object of the present invention to provide a urinal attachment for a toilet which provides for a more hygienically acceptable space in which the toilet is mounted as a result of the reduction in splashing of the waste onto the toilet and the perimeter surrounding the toilet.

It is another object of the present invention to obviate the need for a user to have to touch the toilet seat when raising the toilet lid to urinate, due to the construction and arrangement of the urinal attachment and the coaction with the lid of the toilet.

It is another object of the present invention to provide a reduction in the distance in which urine has to travel in order to be removed as waste, thereby further reducing inadvertent splashing of waste on the toilet or in the area surrounding the toilet.

It is another object of the present invention to provide a urinal attachment for a toilet which when mounted to the lid of the toilet does not obstruct conventional use of the toilet bowl.

The objects of the present invention are accomplished by providing a urinal attachment for a toilet consisting of a supply hose having a first end connected to a water supply for the toilet, and a second end terminating at a position proximate to a lid of the toilet, a valve in communication with the supply hose for controlling the flow of water from the water supply to the second end of the supply hose, and a container for receiving waste mounted adjacent to the lid of the toilet, the container having a first opening for receiving the second end of the supply hose and a second opening in communication with a drain for the toilet.

BRIEF DESCRIPTION OF THE DRAWINGS

For a more complete understanding of the present invention, reference may be had to the detailed description of the preferred embodiments of the present invention considered in connection with the accompanying drawings, in which.

DETAILED DESCRIPTION OF THE PREFERRED EMBODIMENTS

Figure 1:
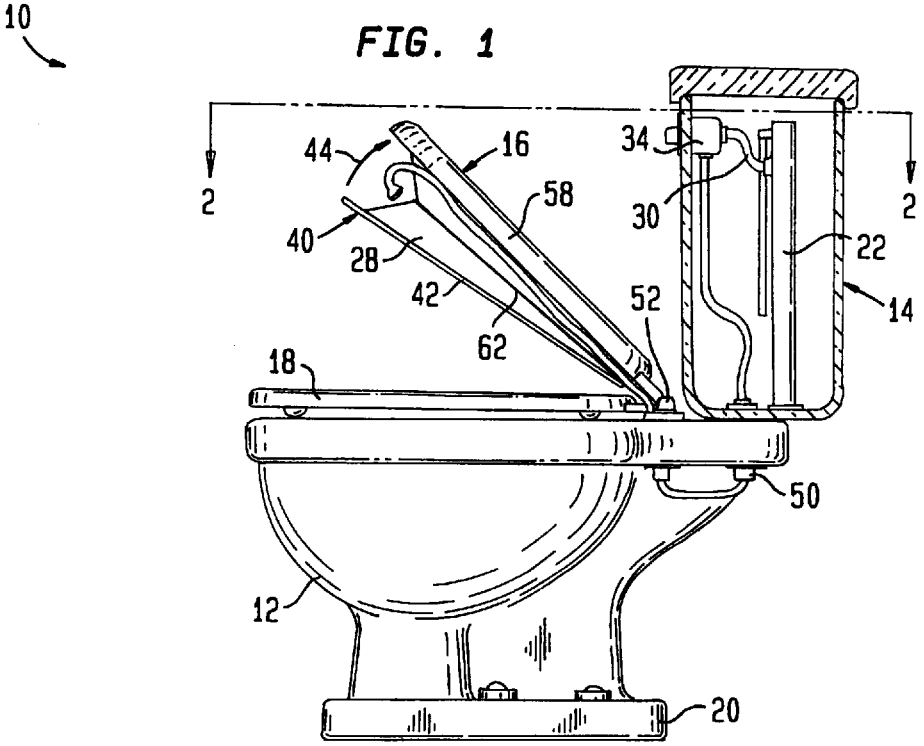
FIG. 1 is a partial cross sectional elevational view of a urinal attachment of the present invention mounted to a toilet bowl.
Figure 2:
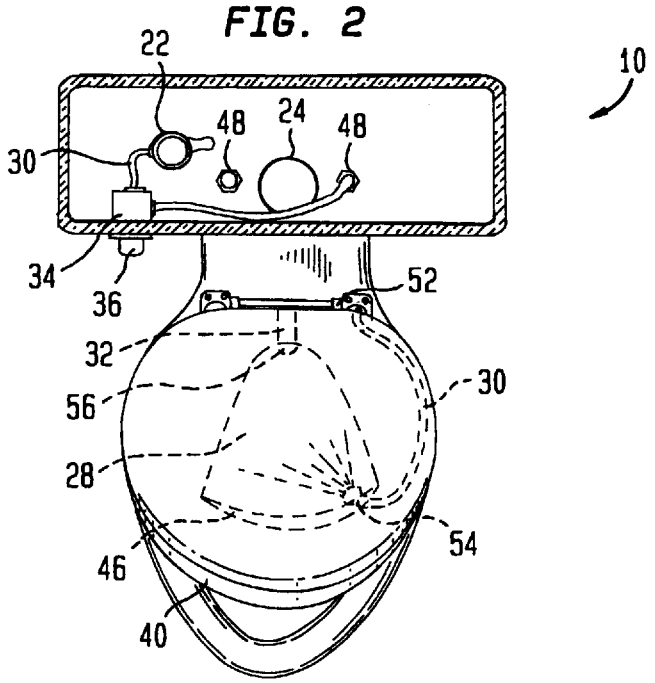
FIG. 2 is a partial cross sectional top plan view of the urinal attachment of the present invention taken through line 2—2 in FIG. 1.
Figure 3:
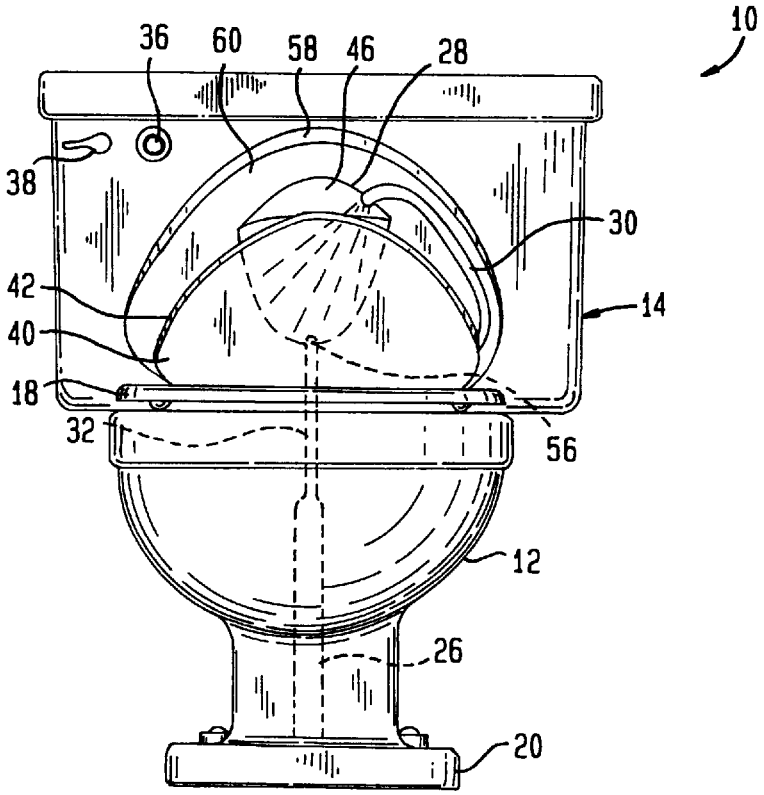
FIG. 3 is a front plan view of a toilet bowl showing the urinal attachment of the present invention mounted thereto.

Referring to FIGS. 1–3, where like elements of the present invention are represented by similar reference numerals, there is disclosed a conventional toilet 10 consisting of a bowl 12 into which waste is deposited, a tank 14 for holding water to rinse and flush the toilet 10, and a cover for the bowl 12 which consists of a lid 16 and a seat 18. A pedestal 20 supports the bowl 12 and hence the toilet 10 off an underlying surface (not shown). The toilet 10 also includes a fill pipe 22 which extends into the tank 14 to provide water to the tank 14, and a duct 24 through which water in the tank 14 flows into the bowl 12. The bowl 12 is also provided with a drain pipe 26 from which water in the bowl 12 is removed into plumbing (not shown) of the dwelling space. The conventional toilet also includes a float (not shown) and flapper valve (not shown) which coact with the fill pipe 22 to regulate the level of water in the tank 14 and the flow of water through the duct 24.

The urine attachment of the present invention consists of a plurality of elements which are retrofitable to the conventional toilet 10. In addition, the elements of the present invention can be constructed with the manufacture of the conventional toilet such that the urine attachment is hidden from view from the observer.

Specifically, the invention consists of a container or receptacle, such as a pouch 28, mounted beneath the lid 16. The pouch 28 is connected to the fill pipe 22 by a rinse hose 30, and connected to the drain pipe 26 by a drain hose 32. The rinse and drain hoses are preferably formed of flexible material. The pouch 28 provides a receptacle into which males can urinate, and requires substantially less water to rinse than the amount of water used to flush the bowl 12. The construction and operation of the invention permits a tremendous amount of water to be saved, particularly in commercial establishments or dwellings with high occupancy levels.

A push button valve 34 is interposed at the rinse hose 30 in the tank 14 to control and regulate water entering the rinse hose 30 from the fill pipe 22. The valve 34 includes an actuator button 36 at an exterior of the tank 14. In a preferred embodiment, the actuator button 36 can be constructed with a lever 38 to flush the bowl 12.

Another part of the present invention is a plate 40 which is hingedly connected to the lid 16 to coact therewith. A peripheral edge 42 of the plate 40 substantially conforms to be positioned against an underside of the lid 16 to sandwich the pouch 28 therebetween. That is, when the plate 40 is moved against the lid 16 as indicated by the arrow 44, the pouch 28 collapses such that it is hidden from view between the lid 16 and the plate 40 which elements coact to closely resemble a uniform structure. The pouch 28 and rinse hose 30 are therefore relatively unobtrusive.

Similarly, when the urinal attachment of the present invention is not in use, the plate 40 is positioned against the lid 16 and both elements are placed in a downward position against the seat 18. The hinged cooperation between the lid 16 and the plate 40 are such that elevation of the lid 16 into an upright position toward the tank 14 will cause the plate 40 to move in conjunction therewith so that access to the bowl 12 is provided without seeing the pouch 28 and rinse hose 30. If it is desired to use the pouch 28, the plate 40 can be separated from the lid 16 thereby providing access to the pouch 28 for use as intended.

The drain hose 32 which communicates with the pouch 28 at a side thereof opposite to an opening 46 of the pouch is substantially unobtrusive.

The tank 14 is secured to the bowl 12 with bolts 48 and nuts 50. The lid 16 and seat 18 of the toilet are hingedly connected to the bowl 12 with a hinge assembly 52.

The rinse hose 30 is guided upward along the underside of the lid 16 and terminates in a nozzle 54 or atomizer facing into the pouch 28. The nozzle 54 disburses a spray of water to contact the interior surface of the pouch 28 to thoroughly rinse the pouch 28 of urine. The urine and waste water are removed from the pouch 28 through an aperture 56 at the base of the pouch 28 opposite to the opening 46. The opening 46 is in communication with the drain hose 32 as shown in FIG. 3, which extends to communicate with the drain pipe 26 of the toilet.

In a preferred embodiment, the nuts 48 and bolts 50 are constructed such that the rinse hose 30 can be guided therethough (FIGS. 1 and 2) so that only a small portion of the hose is observed from an exterior of the toilet as shown, for example, in FIG. 1.

In another preferred embodiment, the lid 16 is formed with a peripheral edge 58 which extends upward from the lid 16. This manner of construction of the peripheral edge 58 provides for a depressed surface 60 extending along an underside of the lid 16 as shown in FIG. 3. The construction and arrangement of the peripheral edge 58 and the depressed surface region 60, and the peripheral edge 42 of the plate 40 provide for a pocket in which the pouch 28 is sandwiched when the plate 40 and the lid 16 are brought together. That is, the peripheral edge 42 of the plate 40 is seated within the peripheral edge 58 of the lid 16, with the depressed surface region 60 providing a space in which the pouch 28 is disposed.

Lines of weakness 62, such as folds in a sidewall of the pouch 28 facilitate the collapsing of the pouch 28 against the lid 16 and the plate 40.

The elements of the present invention do not require a separate pump assembly or power source to operate the urine attachment. That is, the rinse hose 30 is tapped into the fill pipe 22 and therefore uses the pressure of the incoming water at the fill pipe 22 to propel the water through the hose 30 when the actuator button 36 of the valve 34 is depressed. Preferably, as long as the button 36 is being depressed, the flow of water from the valve 34 is continuous.

The flexible material of the hoses 30,32 and pouch 28 preferably have a natural resiliency to permit the pouch 28 to collapse and be sandwiched between the plate 40 and the lid 16 such that the pouch 28 of the present invention is unobservable and there does not appear to be any additional structure mounted to the conventional toilet. Similarly, if the user does not wish to use the urine attachment of the present invention, the plate 40 and the lid 16 can be pivoted together as a unit away from the bowl thereby providing access thereto for a conventional manner of use.

It will be understood that the embodiments described herein are merely exemplary and that a person skilled in the art may make many variations and modifications without departing from the spirit and scope of the invention. All such modifications and variations are intended to be included within the scope of the invention as defined in the appended claims.

What is claimed is:

1. A urinal attachment for a toilet, comprising:

a flexible supply hose having:

a first open end adapted to be connected to a water supply for the toilet, a second open end terminating at a position proximate to a lid of the toilet, and a spray nozzle mounted to the second open end for emitting a spray of water;

a valve adapted to be mounted to an interior of a tank for the toilet and in communication with the flexible supply hose, the valve including:

a push button adapted for extending from the valve through a sidewall of the tank for actuation of the valve from an exterior of the tank;

a plate adapted to be mounted to the toilet for pivotal coaction with the lid of the toilet for providing a space between the lid and the plate;

a flexible pouch adapted to be mounted adjacent to the lid of the toilet, the flexible pouch having:

an upper surface adapted to be attached to the lid of the toilet, a lower surface attached to the plate, a first opening for receiving the spray nozzle to emit water at the interior of the flexible pouch, a second opening at a side of the flexible pouch opposite to that of the first opening, a fold line along the flexible pouch for permitting the flexible pouch to move between a collapsed and opened position between the lid and the plate; and a drain hose having a first end in communication with the second opening of the flexible pouch, and a second end extending to and adapted for communication with a drain for the toilet;

wherein separation of the lid from the plate deploys the flexible pouch into an open position to expose the first opening of the flexible pouch to receive urine, and movement of the plate toward the lid collapses the flexible pouch such that the first opening is closed between the plate and the lid.

2. A urinal attachment for a toilet, comprising:

a supply hose having a first end adapted to be connected to a water supply for the toilet, and a second end terminating at a position proximate to a lid of the toilet;

control means in communication with the supply hose for controlling a flow of water from the water supply to the second end of the supply hose;

a flexible pouch adapted to be mounted adjacent to the lid of the toilet, the pouch having a first opening into which urine is received and for receiving the second end of the supply hose, and a second opening in communication with a drain for the toilet; and a plate adapted to be mounted to the toilet for pivotal coaction with the lid of the toilet for retaining the flexible pouch between the lid and the plate;

an upper surface of the flexible pouch being adapted for attachment to the lid of the toilet and a lower surface being attached to the plate such that separation of the lid from the plate deploys the pouch into a first position to expose the first opening for receipt of urine, and movement of the plate and lid to a second position where the plate and lid are in facing engagement with each other collapses the pouch such that the first opening of the pouch is closed and the pouch is substantially undetectable from an exterior of the toilet;

wherein the second opening of the supply hose emits water to rinse an interior of the flexible pouch.

3. The urinal attachment according to claim 2, wherein the control means is a push button valve.

4. The urinal attachment according to claim 2, wherein the control means is adapted to be mounted at an interior of a tank for the toilet.

5. The urinal attachment according to claim 4, wherein the control means includes a push button adapted for extending through a sidewall of the tank for actuation of the control means from an exterior of the tank.

6. The urinal attachment according to claim 2, further comprising:

a spray nozzle mounted to the second end of the supply hose for emitting a spray of water at the interior of the flexible pouch.

7. The urinal attachment according to claim 2, wherein the flexible pouch comprises:

lines of weakness along the flexible pouch such that the pouch is collapsible.

8. The urinal attachment according to claim 2, wherein the supply hose and the flexible pouch are constructed of materials having an inherent resiliency.

9. The urinal attachment according to claim 2, further comprising a drain hose having a first end in communication with the second opening of the flexible pouch and a second end extending to and adapted for communication with the drain for the toilet.

10. The urinal attachment according to claim 2, wherein the lid comprises:

a peripheral edge extending from the lid for providing a depressed surface region along the lid facing the bowl of the toilet, the depressed surface region and the peripheral edge adapted for coacting with the plate for providing a space between the lid and the plate in which the flexible pouch is disposed.

11. The urinal attachment according to claim 2, wherein the supply hose is constructed and arranged to extend through the tank and the bowl of the toilet such that the second end of the supply hose is received in the flexible pouch and the supply hose is substantially undetectable from an exterior of the toilet.

* * * * *